US008043477B2

(12) United States Patent
Crook et al.

(10) Patent No.: US 8,043,477 B2
(45) Date of Patent: Oct. 25, 2011

(54) BELT AND METHOD OF MAKING A BELT FOR A PAPER MAKING MACHINE

(75) Inventors: Robert Crook, Wilson, NC (US); Clifton Wilder, Sims, NC (US)

(73) Assignee: Voith Patent GmbH, Heidenheim (DE)

( * ) Notice: Subject to any disclaimer, the term of this patent is extended or adjusted under 35 U.S.C. 154(b) by 664 days.

(21) Appl. No.: 12/036,712

(22) Filed: Feb. 25, 2008

(65) Prior Publication Data

US 2009/0211722 A1 Aug. 27, 2009

(51) Int. Cl.
*D21F 7/10* (2006.01)

(52) U.S. Cl. ..... 162/358.2; 162/900; 162/904; 139/383 AA

(58) Field of Classification Search ..... 162/348, 162/358.2, 900, 902–904; 139/383 A, 383 AA, 139/425 A See application file for complete search history.

(56) References Cited

U.S. PATENT DOCUMENTS

| | | | | | |
|---|---|---|---|---|---|
| 3,283,388 | A | | 11/1966 | Kelleher | |
| 3,815,645 | A | | 6/1974 | Codorniu | |
| 4,574,435 | A | | 3/1986 | Luciano | |
| 4,761,329 | A | | 8/1988 | Halker | |
| 4,781,967 | A | * | 11/1988 | Legge et al. | 428/109 |
| 4,863,786 | A | | 9/1989 | Green | |
| 4,896,702 | A | * | 1/1990 | Crook | 139/383 AA |
| 4,911,683 | A | | 3/1990 | Legge | |
| 5,015,220 | A | | 5/1991 | Legge | |
| 5,110,672 | A | | 5/1992 | Zehle | |
| 5,464,488 | A | | 11/1995 | Servin | |
| 5,571,590 | A | | 11/1996 | Schultz | |
| 5,787,936 | A | | 8/1998 | Snipes | |
| 5,916,421 | A | | 6/1999 | Yook | |
| 6,000,441 | A | * | 12/1999 | Lee et al. | 139/383 AA |
| 6,283,165 | B1 | | 9/2001 | Best | |
| 2003/0183358 | A1 | | 10/2003 | Yook | |
| 2009/0090425 | A1 | * | 4/2009 | Hawes et al. | 139/383 AA |

FOREIGN PATENT DOCUMENTS

| | | |
|---|---|---|
| WO | 89/12717 | 12/1989 |

* cited by examiner

*Primary Examiner* — Eric Hug

(74) *Attorney, Agent, or Firm* — Greenblum & Bernstein, PLC

(57) ABSTRACT

Belt and method of making a belt for a paper making machine. The belt includes a flat woven material having a top side surface and a bottom side surface and two terminal ends separated in a machine direction. Folds formed in the flat woven material are separated in the machine direction, so that the two terminal ends are located under the bottom side surface. Seam loops are located at the folds, and the two terminal ends one of are arranged adjacent each other and overlap each other in a region offset from a center between the folds. The instant abstract is neither intended to define the invention disclosed in this specification nor intended to limit the scope of the invention in any way.

23 Claims, 2 Drawing Sheets

BELT AND METHOD OF MAKING A BELT FOR A PAPER MAKING MACHINE

BACKGROUND OF THE INVENTION

1. Field of the Invention

The invention is directed to forming a seamable belt for a paper making machine and, in particular, a seamable belt base for a paper making machine.

2. Discussion of Background Information

It is known from International Publication No. WO 89/12717 that a seam capable base for a press fabric can be created by "folding" a tube of woven fabric and removing cross-direction (CD) yarns at the folds on each end. In this way, machine direction (MD) yarns at these ends or folds can then function as the seam loops. The ends or seam loops of the base can be aligned and connected with a pintle to form an endless base for the belt. The base can be needled and finished in any conventional matter in order to form a normal press seam fabric.

In other methods, it is known that the above-noted tube of fabric can be constructed with a spiraled "multiaxial" method. However, to use endless woven or spiraled tubes in the above-noted manner, the tubes have to be produced to length based on the order. Further, as these tubes are generally only about 1-1.5 m wide, a number of these folded tubes must be combined with MD joins in order to achieve a width of 10-12 m, which is generally utilized in paper making machines. The ends of these tubes can be joined together by forming MD yarn loops by removing CD yarns.

Further, as an array of parallel yarns "reinforced" with needled batt, resins, or other nonwovens can be utilized in forming the described tube for the base, a strong single layer top ply fabric can be provided over the joined area, or needled batt, added resin, thermoplastic "welding", etc. to keep the join in the two fabric ends intact for processing. Still further, a knit fabric can be used where the loops are provided as a spiral link.

In a further alternative, it is known to position a membrane "insert" within the tube, e.g., prior to folding.

SUMMARY OF THE INVENTION

The present invention is directed to a method of forming a belt for a paper making machine. The belt includes a base structure composed of a woven material or fabric in which the MD ends of the base structure are formed by folding over portions of the MD ends of the fabric. The folded over portions of the MD ends of the fabric can be attached to the bottom side of the base. Seam loops can be formed in the MD ends of the base structure, e.g., by forming a separation between the CD threads, and preferably without removing CD threads. The woven fabric can be an endless woven or flat woven fabric, and can be of single layer construction.

In an exemplary embodiment of the invention, the portions of the MD ends of the fabric can be folded over so the MD ends of the fabric can be arranged to in close proximity to, and preferably abutting, each other, or can be arranged to overlap or be intermeshed with each other. The MD ends of the fabric can be arranged to either abut or overlap each other in close proximity to, e.g., within 4', preferably between 1"-36", and more preferably between 12" and 36" of one of the fold ends of the base structure. Further, the folded portions of the MD fabric can be attached to the bottom side of the base structure by, e.g., sewing an MD seam in a region of the MD end of the fabric and/or sewing an MD seam joining both MD ends to the bottom side of the base structure.

According to another aspect of the invention, the base structure can include an enveloped insert composed of, e.g., a formed polyurethane composite nonwoven membrane, such as a SPECTRA membrane manufactured by Voith Fabrics, or another non-flat woven fabric, preferably including an elastomer, or knit material. The insert may be smaller than a full width of the base structure as long as the insert provides desired stiffening and/or fiber bonding, e.g., in the form of a low melt fabric or scrim.

The present invention is directed to a belt for a paper making machine that includes a flat woven material having a top side surface and a bottom side surface and two terminal ends separated in a machine direction. Folds formed in the flat woven material are separated in the machine direction, so that the two terminal ends are located under the bottom side surface. Seam loops are located at the folds. The two terminal ends one of are arranged adjacent each other and overlap each other in a region offset from a center between the folds.

According to a feature of the invention, portions of the flat woven material from the two terminal ends to the folds can be adhered to the bottom side surface.

According to another feature of the invention, the two terminal ends may be sewn to the bottom side surface.

Further, the two terminal ends offset from the center can be located within 4" of one of the folds. Moreover, the two terminal ends offset from the center may be located between 1" to 36" from the one of the folds.

In accordance with still another feature of the present invention, a density of cross-direction fibers in a region of the seam loops is greater than a density of cross-direction fibers toward a center between the folds.

According to a further feature, an insert can be located between the folds, the bottom side surface and the two terminal ends arranged adjacent each other. Further, the insert can include polyurethane, and can be a nonwoven membrane. The insert can also include another flat woven fabric, and the insert, the two terminal ends, and the bottom side surface may be sewn together.

In accordance with still another feature of the instant invention, a pintle can be insertable through the seam loops, thereby forming a belt seam.

According to another feature, a batt layer can be needled onto at least one of the top side surface and a surface comprising the terminal ends.

The invention is directed to a method for forming a belt for a paper making machine from a flat woven fabric having a top side surface and a bottom side surface and two terminal ends separated in a machine direction. The method includes forming folds in the flat woven fabric so the two terminal ends are positioned under the bottom side surface and one of adjacent each other and overlapping each other, attaching the two terminal ends and the bottom side surface together in a region offset from a center between the folds, and separating adjacent cross direction threads in the folds to form seam loops.

In accordance with a feature of the instant invention, the attaching may include sewing the terminal ends and the bottom side surface together.

According to another feature of the invention, the separating of the adjacent cross direction threads in the folds can create a greater density of cross-direction fibers in a region of the seam loops than in a region of the center between the folds.

In accordance with still another feature of the present invention, the two terminal ends and the bottom side surface can be attached within 4' of one of the folds. Further, the two terminal ends and the bottom side surface are attached at a located between 1" to 36" from the one of the folds.

Moreover, the method can further include inserting an insert between the folds, the bottom side surface and the two terminal ends arranged adjacent each other. The insert may include a polyurethane nonwoven membrane.

The method may also include sewing together the insert, the two terminal ends, and the bottom side surface.

According to still another feature of the invention, the method can also include inserting a pintle through the seam loops, thereby forming a belt seam.

In accordance with still another feature of the invention, the method can include needling a batt layer onto at least one of the top side surface and a surface comprising the terminal ends.

According to another feature, the method can include further include fringing the two terminal ends. The fringed terminal ends can be arranged to overlap, and the overlapped fringed terminal ends to the bottom side surface may be attached by at least one stitch.

In accordance with still yet another feature of the present invention, the method can include coupling a two layer fabric belt to one of the top side surface and a surface including the terminal ends.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
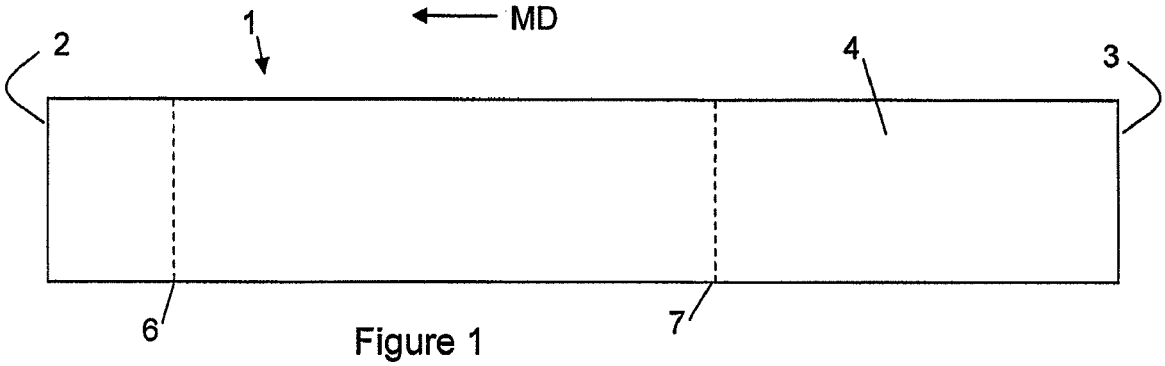
FIGS. 1 and 2 illustrate a top and side view of a woven fabric to form a belt according to the invention.
Figure 2:
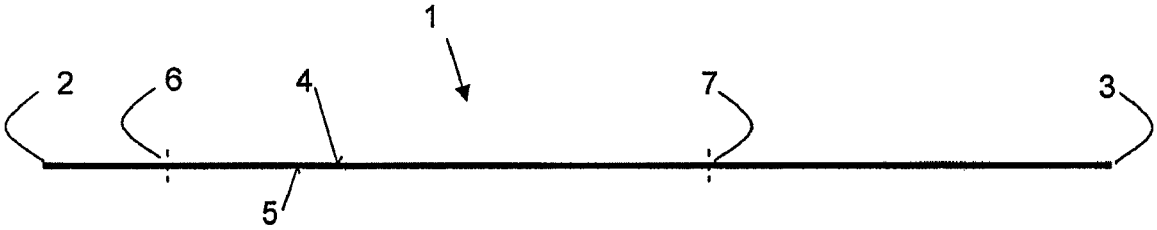

According to embodiments, FIGS. 1 and 2 illustrate a top and side view, respectively, of a woven material 1, e.g., a flat woven material or fabric having opposing terminal ends 2 and 3 separated in a machine direction (MD), which can be used to form a base structure for a belt of a paper making machine. Woven material 1 has an MD length that is approximately twice the length or circumference of the desired finished belt and includes a top surface 4 and a bottom surface 5. The woven material 1 can be a stock pre-made fabric, and may preferably be a flat produced stock material. Such a pre-made fabric can be cut to a desired or ordered size to form a belt of desired length or circumference. By way of example, modern weaving machines, which are essentially fully automated or robots, can continuously weave the flat stock fabric without an operator, without breaks or down time, etc. Moreover, while the woven material 1 in the exemplary embodiment is identified as a single layer woven structure, the invention is not limited to such a structure. That is, double or triple layer woven fabrics can also be employed to enhance void volume and compaction resistance without departing from the spirit and scope of the invention.

By way of non-limiting example, woven fabric 1 can be produced on wide weaving loom, e.g., a twelve (12) meter wide weaving loom for robotic flat stock fabric weaving. While twelve meters is wide enough for existing paper machines, it may be advantageous to select smaller loom sizes to minimize or avoid waste for belts having a smaller CD dimension. Moreover, the fabric can be formed with, e.g., eighteen (18) ends per inch of 0.50 mm nylon 6 MD yarns and eighteen (18) ends per inch of the same yarns in the CD direction using a single layer plain weave. The fabric may be cut to length from a stock piece when orders are received. Further, it may be beneficial to perform the cutting with a hot knife so as to fuse the cut ends.

Further, woven fabric 1 can be selected with MD and CD interwoven textile yarn systems because these fabrics are more stable in the CD and/or MD directions, thereby allowing predictability in running size, and in stretching, widening or shrinking while running. Further, it may also be advantageous to utilize a full width stock fabric so that no MD joins are needed. In this way, the belt can then be easily assembled into a finished fabric in any conventional manner, which can include, e.g., washing the felt, applying a thermal treatment bonding to the felt, etc.

Figure 3:
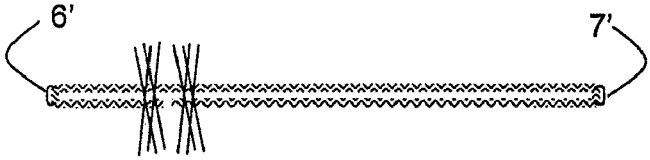
FIG. 3 illustrates an embodiment of the invention in which the belt is not seamed.

An end portion of woven fabric 1, i.e., from a fold line 6 to terminal end 2, can be folded over onto itself, and another end portion of woven fabric 1, i.e., from fold line 7 to terminal end 3, can be folded over onto itself, as shown in FIG. 3. In this manner, an endless belt, or a belt base for an endless belt, having a length generally corresponding to a distance between fold lines 6 and 7 can be formed from the finished folded fabric by joining fold lines 6 and 7 with a seam. To form a seam, the cross-direction (CD) threads at fold lines 6 and 7 can be separated from each other to expose MD threads to form seam loop ends 6' and 7', as shown in FIG. 3. Preferably, the CD threads are not removed, but instead a tool, e.g., a comb or other suitable device, can be inserted between adjacent CD threads at the folds and the adjacent CD threads can then be mechanically separated. As a result, the CD threads adjacent the separation become crowded together as the MD threads are revealed. By way of non-limiting example, the CD yarns can be reformed, without removal, in order to crowd the CD ends close together, so that approximately 25% or more ends per inch are arranged adjacent the seam loops formed in the MD yarns as compared to the body.

Moreover, the invention can create substantially increased CD yarn density adjacent to the seam loops by "slipping" the yarns back into the body weave, with proper use to mechanical force, temperature, added stitching yarns, etc. In this way, fiber bonding at the seam can be improved, and loops sizes can be more consistent. Moreover, the time consuming and damage prone operation of removing CD yarns can be minimized or preferably eliminated, depending on the type of construction used.

Further still, once the MD thread loops are formed, a stitch can be sewn in the CD direction along or near the base of loops 6' and 7'. Further, the stitch can be formed between the MD yarns to prevent CD migration and keeps the MD threads aligned.

As shown in FIG. 3, when folded, terminal ends 2 and 3 can be arranged in close proximity or adjacent each other, and can be arranged to abut each other. Terminal ends 2 and 3 may be attached to the bottom side surface 5 of a portion (the body) of woven fabric 1 between dashed lines 6 and 7, e.g., by sewing or stitching each end (schematically illustrated with Xs). The threads or yarns sewn into the ends reinforces the join to provide positive support of the join on the paper machine. Additionally or alternatively, terminal ends 2 and 3 can be sewn across the join (not shown). In embodiments, the ends can be sewn with a fine diameter thread that is tough and durable. However, the threads do not cause significant change to caliper or porosity uniformity of this area of the sewn ends as compared to the base structure body or the seam loop areas.

Adjacent, and preferably abutted, terminal ends 2 and 3 are arranged, not in the center of the base structure between folds 6 and 7 of woven fabric 1, but instead are offset from the center and located, e.g., in close proximity, e.g., within 4', preferably between 1"-36", and more preferably 12"-36", to one of seam loop end 6' or 7'. By positioning the abutted ends in close proximity to one of the seam loop ends 6' or 7', each end and/or the join can be sewn in the cross-direction using, e.g., industrial sewing machines of "conventional" throat depth.

Figure 4:
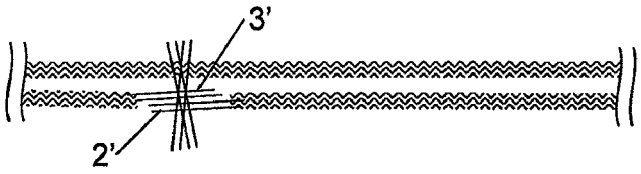
FIG. 4 illustrates an embodiment of the invention in which the terminal ends of the woven fabric are fringed.

In an advantageous alternative embodiment, terminal ends 2 and 3 can be fringed by removing CD threads, e.g., about 0.25" of CD threads from the terminal ends 2 and 3. As shown in FIG. 4, which illustrates an alternative manner of joining the terminal ends and the bottom side surface 5 of the folded fabric, instead of abutting terminal ends 2 and 3, as depicted in FIG. 3, after folding the terminal (and fringed) ends 2' and 3' over, the fringed terminal ends 2' and 3' can be overlapped, and stitched down (schematically illustrated with Xs). In a further alternative, the fringed terminal ends 2' and 3' can be intermeshed and stitched after the terminal (and fringed) ends 2' and 3' are folded over. It is understood that the fringing would generally extend in a CD direction of the terminal end, and the illustration in FIG. 4 is intended merely for ease of explanation and understanding of this embodiment of the invention. Thus, neither this embodiment nor the illustration should be deemed as limiting the invention to any specific embodiment or arrangement.

Figure 5:
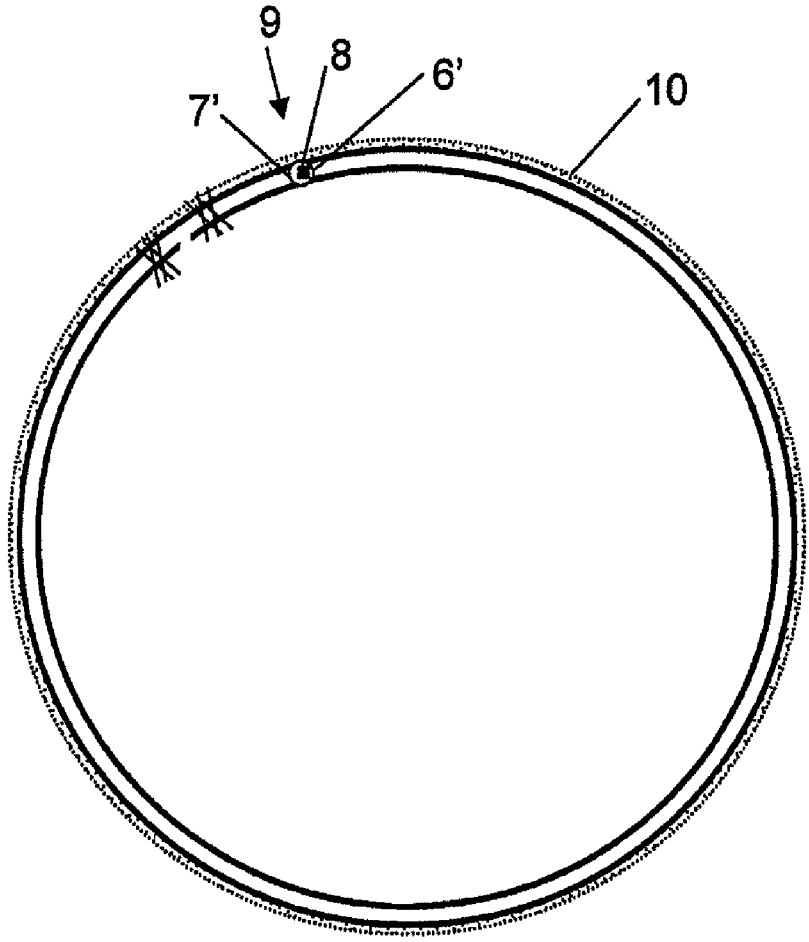
FIG. 5 illustrates an embodiment of the invention in which the belt is seamed.

After the base structure of FIG. 3 or FIG. 4 is formed, the seamable ends of the base structure can be joined together to form an endless belt, as illustrated in FIG. 5. In this regard, MD loops 6' and 7' can be arranged to overlap each other to form an opening to receive a pintle 8 which holds MD loops 6' and 7' in place, and thereby forms the seam 9. For best seam quality and consistency, CD yarn or filament can be arranged adjacent seam loops 6' and 7' to run the full width of the fabric without interruption. Further, this CD yarn or filament may be the same as the woven warp yarn, but woven at a higher packing density in terms of yarns per inch than in the body. It is also understood that the CD yarn or filament may be of a different yarn type, may be inserted in a different manner, e.g., passing between the top and bottom plies of the fabric, passing through just in one ply, or passing through both plies. The invention further contemplates, but is not limited to, a CD yarn or filament composed of a multifilament, ribbon shaped yarn, and/or low melt yarn, etc. to enhance fiber bonding in the area of seam 9 in the finished fabric. However, it is understood that it may be advantageous for the CD yarn or filament to be continuous, and to increase the density of the fabric at the seam end adjacent to the loops as compared to the body of the woven fabric.

Moreover, the belt or base structure of the invention can be seamed and placed on a needling device, which is generally known in the art. A batt layer 10 can be needled onto the seamed base structure to cover seam 9 so as to prevent disadvantageous marking of the web due to a variance in the caliper at seam 9. Fibers in batt layer 10 can be needled or punched through at least one and preferably the two plies of the folded woven fabric 1 forming the belt or base structure, thereby providing further stability. Of course, it is likewise understood that batt layer 10 can be needled onto the belt or base structure prior to forming seam 9. In such an event, it may be advantageous to provide a suitable and additional amount of batt fiber 10 arranged to extending or hang over at least one of the seam loop ends so that this additional amount of batt fiber will cover over seam 9 after the seaming of the belt.

Figure 6:
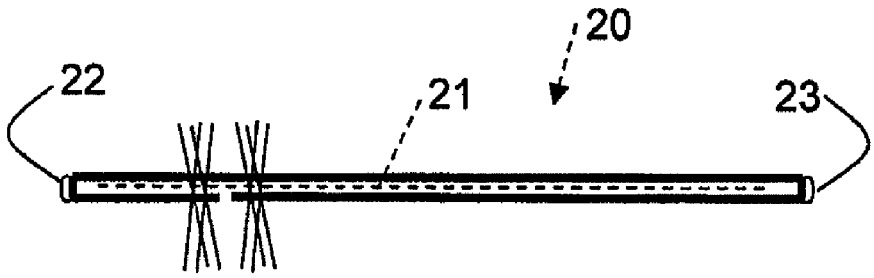
FIG. 6 illustrates an alternative embodiment utilizing an insert.

In an alternative embodiment illustrated in FIG. 6, woven fabric 20 can be wrapped around an insert 21 to improve characteristics of the belt, such as compaction resistance, caliper retention, vibration damping, steady state water handling, etc. After positioning insert 21 between the plies of folded woven fabric 20, the plies can be adhered to insert 21, e.g., by sewing the plies (and insert) together at the join, at which the terminal ends, in accordance with the invention can be adjacent, abutting, overlapping, or intermeshed with each other. By way of example, insert 21 can be a polyurethane composite nonwoven membrane, e.g., a SPECTRA membrane manufactured by Voith Fabrics, sandwiched between the plies of woven stock fabric 1. In a further alternative, insert 21 could also be another non-folded flat woven fabric, knit material, etc. Such an insert 21 can help the join area resist opening or peel back in use due to its added tensile strength/modulus and bending stiffness. Moreover, this insert 21 can help to hold the needled batt to improve the join and the seam flap durability.

Insert 21 is generally not relied upon for dimensional stability, since such stability can be obtained from the base structure, but rather to improve fabric performance in the press nip for water handling, preferably with an elastomeric content fabric maintaining a separation between the two woven plies, and to provide reinforcement for the CD join formed by terminal fabric ends 22 and 23. To reinforce the CD join of terminal ends 22 and 23, or for other performance reasons, insert 21 need not extend to the full or entire width of woven fabric 20. Instead, it can be just near the seam edge or seam ends to provide stiffening and fiber bonding, in the form of a low melt fabric or scrim, etc.

In another alternative embodiment, a non-woven parallel array of MD yarns can be laminated onto the bottom side of the flat woven seam base, e.g., using meltable yarns that fuse into the needled batt. This embodiment may be advantageous in that these added yarns may protect the joined ends of the flat base from abrasive wear and reduce the risk of the join failing on the paper machine. Moreover, while other fabric laminates may also be used without departing from the spirit and scope of the invention, wound yarns may provide beneficial results. Further, these yarns can be combined with the above-discussed insert to achieve an extremely compaction resistant multi-layered structure that is easy to pin with a single seam, and very efficient to produce.

In a further embodiment of the invention, the folded fabric belt or belt base formed in accordance with the features of the present invention can be coupled to, e.g., laminated with, another belt, such as a single ply fabric belt or belt base, a double ply fabric belt or belt base, or a folded fabric belt or belt base formed, e.g., in accordance with the invention. In this manner, a 1+2 or a 2+2 double seam fabric belt can be advantageously formed. Of course, this description is for the purpose of ease of explanation and understanding of the invention and is not intended to limit the invention to any particular embodiment or arrangement. Thus, it is understood that the belt or belt base of the invention can be joined with or to other belts or belt bases without departing from the spirit and scope of the invention.

The above-discussed embodiments of the invention have been provided to explanation and to facilitate the understanding of the invention. However, it is understood that the invention is neither limited to a single layer structure, nor to homogenous yarn selection in the MD or the CD. A further advantage of flat weaving can be that side by side MD yarn systems coming from two warp beams can be utilized, whereby one system is cabled filaments to hold batt and provide density, and one system is solid monofilaments to provide strong seam loops. Still further, to assist in sheet transfer, it is contemplated to use a different density of MD cabled yarns near the edge of the fabric as compared to the center. Also, CD yarns can be selected to specific performance enhancements, e.g., having yarns for width stability, but also could combine with elastomeric yarns, low melt bonding yarns, etc., without departing from the spirit and scope of the invention.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A belt for a paper making machine, comprising:

a flat woven material having a top side surface and a bottom side surface and two terminal ends separated in a machine direction, folds formed in the flat woven material being separated in the machine direction, whereby the two terminal ends are located under the bottom side surface;

seam loops located at the folds, wherein the two terminal ends, in a region offset from a center between the folds, one of are arranged adjacent each other and overlap each other, and wherein the two terminal ends offset from the center are located within 4' of one of the folds.

2. The belt in accordance with claim 1, wherein portions of the flat woven material from the two terminal ends to the folds are adhered to the bottom side surface.

3. The belt in accordance with claim 1, wherein the two terminal ends are sewn to the bottom side surface.

4. The belt in accordance with claim 1, wherein the two terminal ends offset from the center are located between 1" to 36" from the one of the folds.

5. The belt in accordance with claim 1, wherein a density of cross-direction fibers in a region of the seam loops is greater than a density of cross-direction fibers toward a center between the folds.

6. The belt in accordance with claim 1, further comprising an insert located between the folds, the bottom side surface and the two terminal ends arranged adjacent each other.

7. The belt in accordance with claim 6, wherein the insert comprises polyurethane.

8. The belt in accordance with claim 7, wherein the insert comprises a nonwoven membrane.

9. The belt in accordance with claim 6, wherein the insert comprises another flat woven fabric.

10. The belt in accordance with claim 6, wherein the insert, the two terminal ends, and the bottom side surface are sewn together.

11. The belt in accordance with claim 1, further comprising a pintle insertable through the seam loops, thereby forming a belt seam.

12. The belt in accordance with claim 1, further comprising a batt layer needled onto at least one of the top side surface and a surface comprising the terminal ends.

13. A method for forming a belt for a paper making machine from a flat woven fabric having a top side surface and a bottom side surface and two terminal ends separated in a machine direction, comprising:

forming folds in the flat woven fabric so the two terminal ends are positioned under the bottom side surface and one of adjacent each other and overlapping each other;

attaching the two terminal ends and the bottom side surface together in a region offset from a center between the folds; and separating adjacent cross direction threads in the folds to form seam loops, wherein the two terminal ends and the bottom side surface are attached within 4' of one of the folds.

14. The method in accordance with claim 13, wherein the attaching comprises sewing the terminal ends and the bottom side surface together.

15. The method in accordance with claim 13, wherein the separating of the adjacent cross direction threads in the folds creates a greater density of cross-direction fibers in a region of the seam loops than in a region of the center between the folds.

16. The method in accordance with claim 13, wherein the two terminal ends and the bottom side surface are attached at a located between 1" to 36" from the one of the folds.

17. The method in accordance with claim 13, further comprising inserting an insert between the folds, the bottom side surface and the two terminal ends arranged adjacent each other.

18. The method in accordance with claim 17, wherein the insert comprises polyurethane nonwoven membrane.

19. The method in accordance with claim 17, further comprising sewing together the insert, the two terminal ends, and the bottom side surface.

20. The method in accordance with claim 13, further comprising inserting a pintle through the seam loops, thereby forming a belt seam.

21. The method in accordance with claim 13, further comprising needling a batt layer onto at least one of the top side surface and a surface comprising the terminal ends.

22. The method in accordance with claim 13, further comprising fringing the two terminal ends, wherein the fringed terminal ends are arranged to overlap, and the overlapped fringed terminal ends to the bottom side surface are attached by at least one stitch.

23. The method in accordance with claim 13, further comprising coupling a two layer fabric belt to one of the top side surface and a surface comprising the terminal ends.

* * * * *